US010446384B2

(12) United States Patent
Hager

(10) Patent No.: US 10,446,384 B2
(45) Date of Patent: Oct. 15, 2019

(54) FOURIER TRANSFORM MASS SPECTROMETER

(71) Applicant: DH Technologies Development Pte. Ltd., Singapore (SG)

(72) Inventor: James Walter Hager, Mississauga (CA)

(73) Assignee: DH Technologies Development Pte. Ltd., Singapore (SG)

( * ) Notice: Subject to any disclaimer, the term of this patent is extended or adjusted under 35 U.S.C. 154(b) by 122 days.

(21) Appl. No.: 15/567,474

(22) PCT Filed: Apr. 19, 2016

(86) PCT No.: PCT/IB2016/052226
§ 371 (c)(1),
(2) Date: Oct. 18, 2017

(87) PCT Pub. No.: WO2016/174545
PCT Pub. Date: Nov. 3, 2016

(65) Prior Publication Data

US 2018/0114685 A1 Apr. 26, 2018

Related U.S. Application Data

(60) Provisional application No. 62/152,872, filed on Apr. 25, 2015.

(51) Int. Cl.
*H01J 49/00* (2006.01)
*H01J 49/38* (2006.01)
(Continued)

(52) U.S. Cl.
CPC ..... *H01J 49/38* (2013.01); *H01J 49/08* (2013.01); *H01J 49/4205* (2013.01)

(58) Field of Classification Search
CPC .... H01J 49/00; H01J 49/0027; H01J 49/0031; H01J 49/02; H01J 49/025; H01J 49/06;
(Continued)

(56) References Cited

U.S. PATENT DOCUMENTS 8,395,112 B1 3/2013 Bier
2010/0019143 A1* 1/2010 Dobson ..... H01J 49/0013 250/283
(Continued)

OTHER PUBLICATIONS

International Search Report and Written Opinion for PCT/IB2016/052226, dated Jul. 29, 2016.

*Primary Examiner* — Jason L McCormack
(74) *Attorney, Agent, or Firm* — John R. Kasha; Kelly L. Kasha; Kasha Law LLC

(57) ABSTRACT

A quadrupole is filled with ions and the ions are cooled by applying a pressure and gas flow within the quadrupole. Ions are trapped in the quadrupole by applying a DC voltage and an RF voltage to quadrupole rods of the quadrupole, one or more DC voltages to a plurality of auxiliary electrodes of the quadrupole, and a DC voltage and an RF voltage to an exit lens at the end of the quadrupole. The ions are coherently oscillated after the filling and cooling by applying a coherent excitation between at least two rods of the quadrupole rods. The coherently oscillating ions are axially ejected through the exit lens and to a destructive detector for detection by changing one or more voltages of the one or more DC voltages of the plurality of auxiliary electrodes and changing the DC voltage of the exit lens.

16 Claims, 14 Drawing Sheets

(51) Int. Cl.
*H01J 49/42* (2006.01)
*H01J 49/08* (2006.01)

(58) Field of Classification Search
CPC ..... H01J 49/062; H01J 49/067; H01J 49/26; H01J 49/343
USPC ..... 250/281, 282, 283, 286, 290, 291
See application file for complete search history.

(56) References Cited

U.S. PATENT DOCUMENTS

| | | | | |
|---|---|---|---|---|
| 2010/0084549 | A1 | 4/2010 | Ermakov et al. | |
| 2011/0057095 | A1* | 3/2011 | Loboda ..... | H01J 49/0031 250/282 |
| 2013/0068942 | A1* | 3/2013 | Verenchikov ..... | H01J 49/4245 250/282 |
| 2014/0061460 | A1 | 3/2014 | Houschild et al. | |
| 2015/0155149 | A1* | 6/2015 | Brown ..... | H01J 49/0481 250/282 |

* cited by examiner

100

200

400

500

700

800

900

1100

FOURIER TRANSFORM MASS SPECTROMETER

CROSS REFERENCE TO RELATED APPLICATION

This application claims the benefit of U.S. Provisional Patent Application Ser. No. 62/152,872, filed Apr. 25, 2015, the content of which is incorporated by reference herein in its entirety.

INTRODUCTION

A Fourier transform is a well-known mathematical algorithm that is used to transform a signal in the time domain to a signal in the frequency domain or vice versa. In Fourier transform mass spectrometry (FTMS) ions are excited and their oscillations are measured in the time domain. A Fourier transform is then used to transform the measured time domain oscillations of the ions into the frequency domain. Since the frequency of the oscillation of an ion is inversely proportional to the mass-to-charge ratio (m/z) of the ion, the frequencies found from the Fourier transform are converted to m/z values and a mass spectrum is produced.

Two types of mass spectrometers that perform FTMS are the Fourier transform ion cyclotron resonance (FTICR) mass spectrometer and the orbitrap. The FTICR mass spectrometer traps ions in a Penning trap that confines ions radially using an axial static magnetic field and confines ion axially using a quadrupole electric field. The ions are oscillated by an electric field orthogonal to the magnetic field that excites the ions to their resonant cyclotron frequencies.

The orbitrap includes an outer barrel-like electrode and a coaxial inner spindle-like electrode. An inhomogeneous electric field applied between these electrodes causes the ions to oscillate axially. Both the FTICR mass spectrometer and the orbitrap indirectly measure the oscillations of ions in the time domain. They measure the time domain oscillations as image currents produced by the ions in nearby electrodes.

FTMS provides better resolving power and mass accuracy than other types of mass spectrometry. However, FTMS generally requires complex or special purpose instrumentation. FTMS also is typically more sensitive to pressure than other types of mass spectrometry. As a result, additional systems and methods for FTMS are needed that can reduce the complexity and pressure requirements of conventional instrumentation, while providing the benefits of better resolving power and mass accuracy.

SUMMARY

A system is disclosed for coherently exciting and ejecting ions for destructive Fourier transform mass spectrometry (FTMS) mass analysis using a linear ion trap (LIT) quadrupole. The system includes a quadrupole, an exit lens, a destructive detector, and a processor.

The quadrupole includes quadrupole rods and a plurality of auxiliary electrodes. The quadrupole rods have an entrance end for receiving ions and an exit end for ejecting ions. The exit lens is located coaxially with the quadrupole rods near the exit end of the quadrupole rods. The destructive detector is located coaxially with the exit lens and located on the other side of the exit lens. The processor is in communication with the quadrupole, the exit lens, and the destructive detector.

In order to fill the quadrupole with ions and cool the ions once filled, the processor applies a pressure and gas flow within the quadrupole by controlling gas inlets and outlets of the quadrupole. In order to trap the ions in the quadrupole during the filling and cooling, the processor applies a direct current (DC) voltage and a radio frequency (RF) voltage to the quadrupole rods, one or more DC voltages to the plurality of auxiliary electrodes, and a DC voltage and an RF voltage to the exit lens. In order to coherently oscillate the ions after the filling and cooling, the processor applies a coherent excitation between at least two rods of the quadrupole rods. In order to axially eject the coherently oscillating ions through the exit lens and to the destructive detector for detection after the coherent excitation is applied, the processor changes one or more voltages of the one or more DC voltages of the plurality of auxiliary electrodes and changes the DC voltage of the exit lens.

A method is disclosed for coherently exciting and ejecting ions for destructive FTMS mass analysis using a LIT quadrupole.

A quadrupole is filled with ions and the ions are cooled by applying a pressure and gas flow within the quadrupole by controlling gas inlets and outlets of the quadrupole using a processor. The quadrupole includes quadrupole rods that have an entrance end for receiving ions and an exit end for ejecting ions. The quadrupole also includes a plurality of auxiliary electrodes. An exit lens is located coaxially with the quadrupole rods near the exit end of the quadrupole rods. A destructive detector is located coaxially with the exit lens and located on the other side of the exit lens.

The ions are trapped in the quadrupole during the filling and cooling by applying a DC voltage and an RF voltage to the quadrupole rods, one or more DC voltages to the plurality of auxiliary electrodes, and a DC voltage and an RF voltage to the exit lens using the processor.

The ions are coherently oscillated after the filling and cooling by applying a coherent excitation between at least two rods of the quadrupole rods using the processor.

The coherently oscillating ions are axially ejected through the exit lens and to the destructive detector for detection after the coherent excitation is applied by changing one or more voltages of the one or more DC voltages of the plurality of auxiliary electrodes and changing the DC voltage of the exit lens using the processor.

A computer program product is disclosed that includes a non-transitory and tangible computer-readable storage medium whose contents include a program with instructions being executed on a processor so as to perform a method for coherently exciting and ejecting ions for destructive FTMS mass analysis using a LIT quadrupole. The method includes providing a system, wherein the system comprises one or more distinct software modules, and wherein the distinct software modules comprise a filling and cooling control module, an excitation control module, and an ejection control module.

Filling and cooling control module fills a quadrupole with ions and cools the ions by applying a pressure and gas flow within the quadrupole by controlling gas inlets and outlets of the quadrupole. The quadrupole includes quadrupole rods that have an entrance end for receiving ions and an exit end for ejecting ions. The quadrupole also includes a plurality of auxiliary electrodes. An exit lens is located coaxially with the quadrupole rods near the exit end of the quadrupole rods. A destructive detector is located coaxially with the exit lens and located on the other side of the exit lens.

Filling and cooling control module traps the ions in the quadrupole during the filling and cooling by applying a DC voltage and a radio frequency RF voltage to the quadrupole rods, one or more DC voltages to the plurality of auxiliary electrodes, and a DC voltage and an RF voltage to the exit lens.

Excitation control module coherently oscillates the ions after the filling and cooling by applying a coherent excitation between at least two rods of the quadrupole rods. Ejection control module 1430 axially ejects the coherently oscillating ions through the exit lens and to the destructive detector for detection after the coherent excitation is applied by changing one or more voltages of the one or more DC voltages of the plurality of auxiliary electrodes and changing the DC voltage of the exit lens.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
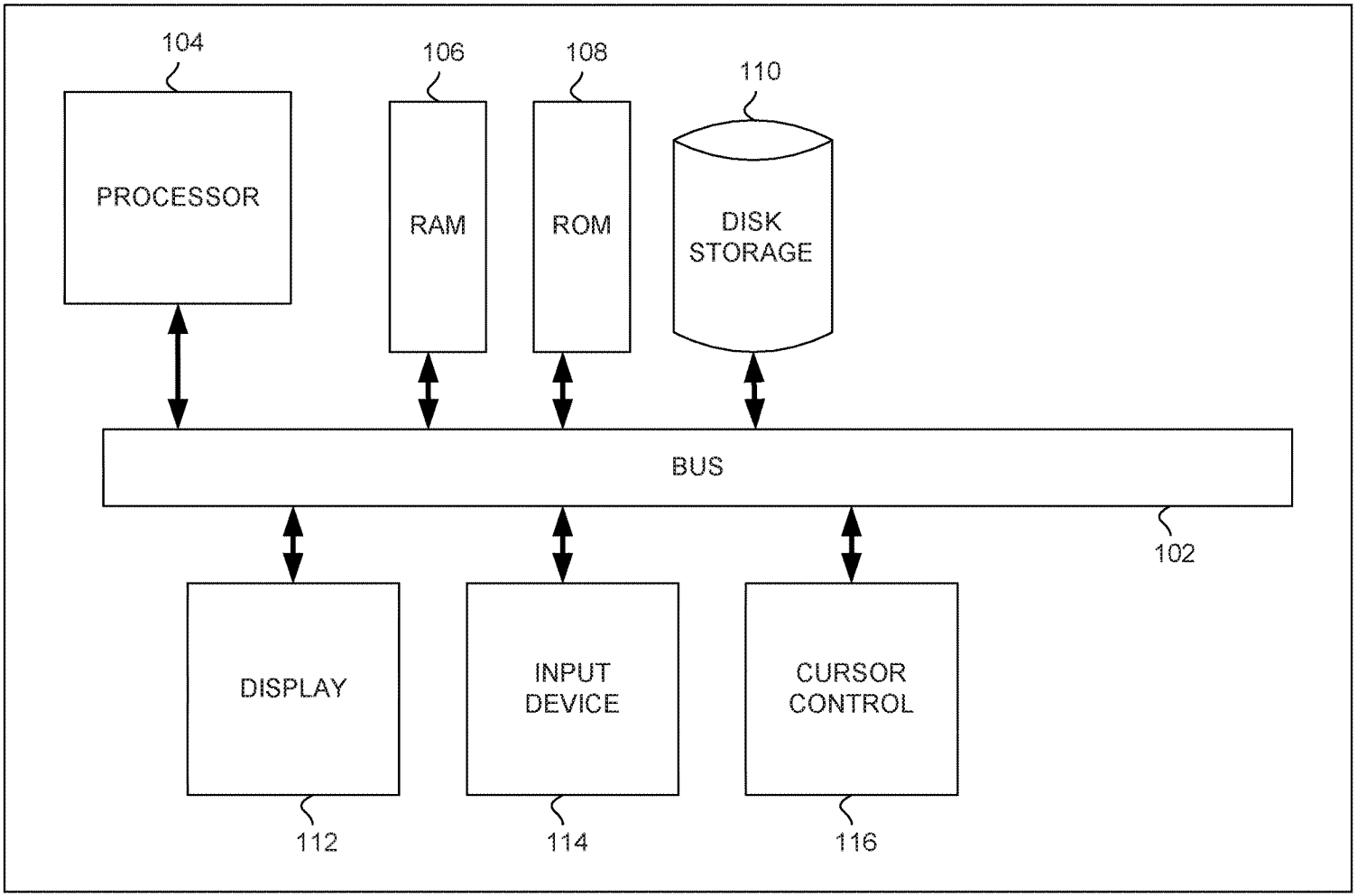
FIG. 1 is a block diagram that illustrates a computer system, upon which embodiments of the present teachings may be implemented.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

In various embodiments, computer system 100 can be connected to one or more other computer systems, like computer system 100, across a network to form a networked system. The network can include a private network or a public network such as the Internet. In the networked system, one or more computer systems can store and serve the data to other computer systems. The one or more computer systems that store and serve the data can be referred to as servers or the cloud, in a cloud computing scenario. The one or more computer systems can include one or more web servers, for example. The other computer systems that send and receive data to and from the servers or the cloud can be referred to as client or cloud devices, for example.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media or computer program products include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

LIT FTMS

As described above, Fourier transform mass spectrometry (FTMS) provides better resolving power and mass accuracy than other types of mass spectrometry. However, FTMS generally requires complex or special purpose instrumentation. FTMS also is typically more sensitive to pressure than other types of mass spectrometry. As a result, additional systems and methods for FTMS are needed that can reduce the complexity and pressure requirements of conventional instrumentation, while providing the benefits of better resolving power and mass accuracy.

In various embodiments, coherent excitation is coupled with axial ion ejection to provide high resolution and high mass accuracy FTMS using a linear ion trap (LIT). The complexity and pressure requirements of this FTMS system are reduced in comparison to conventional systems by using the ion path and vacuum system of a conventional LIT. Acquisition time is also improved over conventional FTMS systems.

FTMS using a LIT has been proposed before. For example, U.S. Pat. Nos. 4,755,670, 6,403,955, and 8,362,418 all describe performing a Fourier transform of an ion signal within a LIT. All three patents also describe measuring ion oscillations nondestructively and indirectly from image currents produced in nearby electrodes. In addition, U.S. Pat. Nos. 4,755,670 and 6,403,955, describe using a pulsed excitation to produce ion oscillation.

No one, however, has proposed using the ion path and vacuum system of a conventional LIT to provide FTMS. Previously, it was thought in the industry that is not possible to detect ion oscillations using the ion path and destructive ion detector of a conventional LIT.

For example, ion coherence is needed for FTMS. Ions are said to oscillate coherently when they all oscillate with the same phase. Coherent oscillation can be produced using a coherent excitation. One exemplary coherent excitation is a short waveform excitation. A short waveform is a waveform that exists for a short period of time. An exemplary short waveform is a pulse. A short waveform excitation can cause a wide mass-to-charge ratio (m/z) range of ions to move or oscillate coherently. Ions excited by a short waveform excitation oscillate coherently for only a short period of time, however. As a result, the excited ions need to be detected by a destructive ion detector of a conventional LIT before coherence is lost.

At the same time, FTMS resolution is dependent on the amount of time a coherent ion oscillation signal is available. In other words, if a coherent ion oscillation signal is measured for a longer period of time, a higher resolution can be obtained. As a result, the ions excited by a coherent excitation also need to be measured over a period of time long enough to provide typical FTMS resolution. Prior to the invention of the various embodiments described herein, the mass spectrometry industry was unable to obtain systems and methods capable of destructively detecting ion oscillations fast enough to prevent the loss of coherence, but slow enough to provide the typical high resolution of FTMS.

Figure 2:
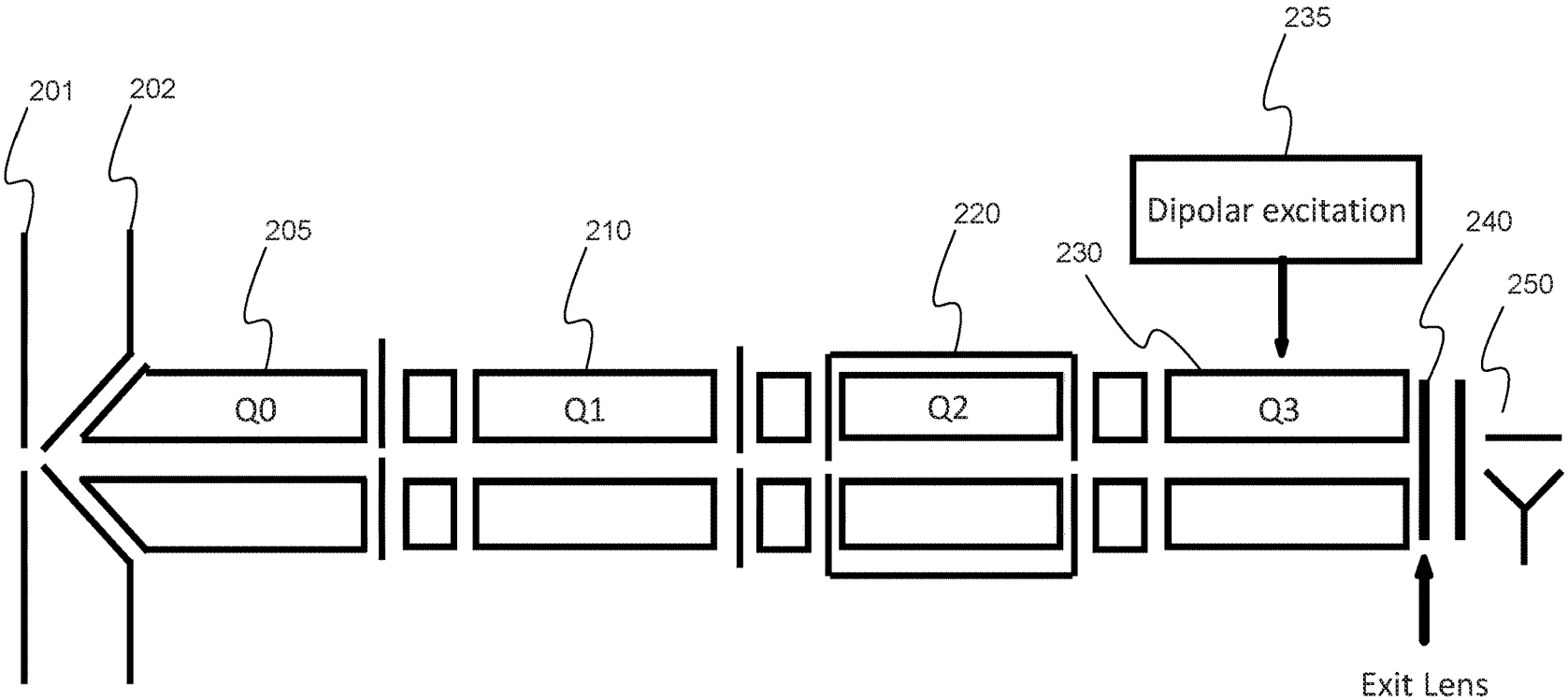
FIG. 2 is an exemplary schematic diagram of a conventional triple quadrupole mass spectrometer that is modified for Fourier transform mass spectrometry (FTMS), in accordance with various embodiments.

FIG. 2 is an exemplary schematic diagram 200 of a conventional triple quadrupole mass spectrometer that is modified for FTMS, in accordance with various embodiments. The triple quadrupole mass spectrometer of FIG. 2 is, for example, a 4000 QTrap® produced by Sciex. The triple quadrupole mass spectrometer of FIG. 2 includes a conventional ion path and vacuum system.

The conventional ion path begins with ionized molecules produced by an ion source (not shown). The ionized molecules pass through orifice 201 and skimmer 202 to reach Q0 quadrupole 205. Q0 quadrupole 205 is used to focus the ionized molecules. Q1 quadrupole 210 is used to select a subset of ions (precursor ions). Q1 quadrupole 210 receives voltages from a voltage source (not shown) that enable Q1 quadrupole 210 to select the subset of ions. The voltage source is, in turn, controlled by a processor (not shown). Q1 quadrupole 210 further transmits the subset of ions to Q2 quadrupole 220.

In Q2 quadrupole 220 the subset of ions are fragmented producing product ions. Q2 quadrupole 220 is, for example, a collisions cell. Q2 quadrupole 220 transmits the product ions to Q3 quadrupole 230 for mass analysis. Q3 quadrupole 230 is a LIT.

Although the ion path of the triple quadrupole mass spectrometer of FIG. 2 is conventional, the instrument itself includes some modifications. For example, radio frequency (RF) and direct current (DC) power supplies (not shown) for Q0 quadrupole 205, Q1 quadrupole 210, Q2 quadrupole 220, and Q3 quadrupole 230 are independently and individually addressable by a processor (not shown). Q1 quadrupole 210 and Q2 quadrupole 220 are operated at about 1.0 MHz, for example. Q3 quadrupole 230 is operated at just under 1.5 MHz, for example.

Q3 quadrupole 230 is used to trap and excite product ions and any residual selected precursor ions for FTMS. The background pressure for Q3 quadrupole 230 can range between about $0.5\times10^{-5}$ and $5\times10^{-5}$ torr, for example. Conventional FTMS instruments require vacuum pressures of on the order of $10^{-9}$ and $10^{-10}$ torr for high resolution, for example.

A coherent excitation is used to excite the ions of Q3 quadrupole 230. The coherent excitation can be any short waveform excitation. In various embodiments, the short waveform excitation produces a short waveform with a sharp leading edge that rises in less than 10 μs. The short waveform excitation can be, for example, a very narrow dipolar excitation pulse. Function generator 235 is used to produce the dipolar excitation pulse. Function generator 235 provides a square pulse with an amplitude of about 5V and a width of between 0.5 to 5 μs, for example. Function generator 235 includes an amplifier to provide on the order of +/−5 to 40 V from the 5 V input in a dipolar fashion using a toroidal transformer, for example. The dipolar excitation pulse is applied between the X rods of Q3 quadrupole 230, for example. Dipolar means that the positive voltage is applied to one rod at the same time the same voltage is applied negatively to another rod.

As described above, the dipolar excitation pulse in Q3 quadrupole 230 causes the product ions and any residual selected precursor ions to coherently oscillate. Coherently oscillating ions are axially ejected from Q3 quadrupole 230 by Q3 quadrupole 230 and exit lens 240. The axially ejected coherently oscillating ions then hit detector 250 and are destructively detected. Detector 250 is, for example, a conventional electron multiplier. The electron multiplier can be a conversion electrode or high energy dynode (HED), for example.

Ion decay signals from detector 250 are received by a processor (not shown) and recorded in a memory (not shown). Ion decay signals are recorded with a 1 μs dwell time, for example. This limits the frequency of the decays that can be analyzed to a few hundred kHz, for example.

As described above a key aspect of various embodiments is destructively detecting ion oscillations fast enough to prevent the loss of coherence, but slow enough to provide the typical high resolution of FTMS. This desired rate of detection is accomplished by axially ejecting coherently oscillating ions from Q3 quadrupole 230 at a precise rate. This precise rate of axial ejection is obtained by controlling specific electrodes of Q3 quadrupole 230 and exit lens 240.

Figure 3:
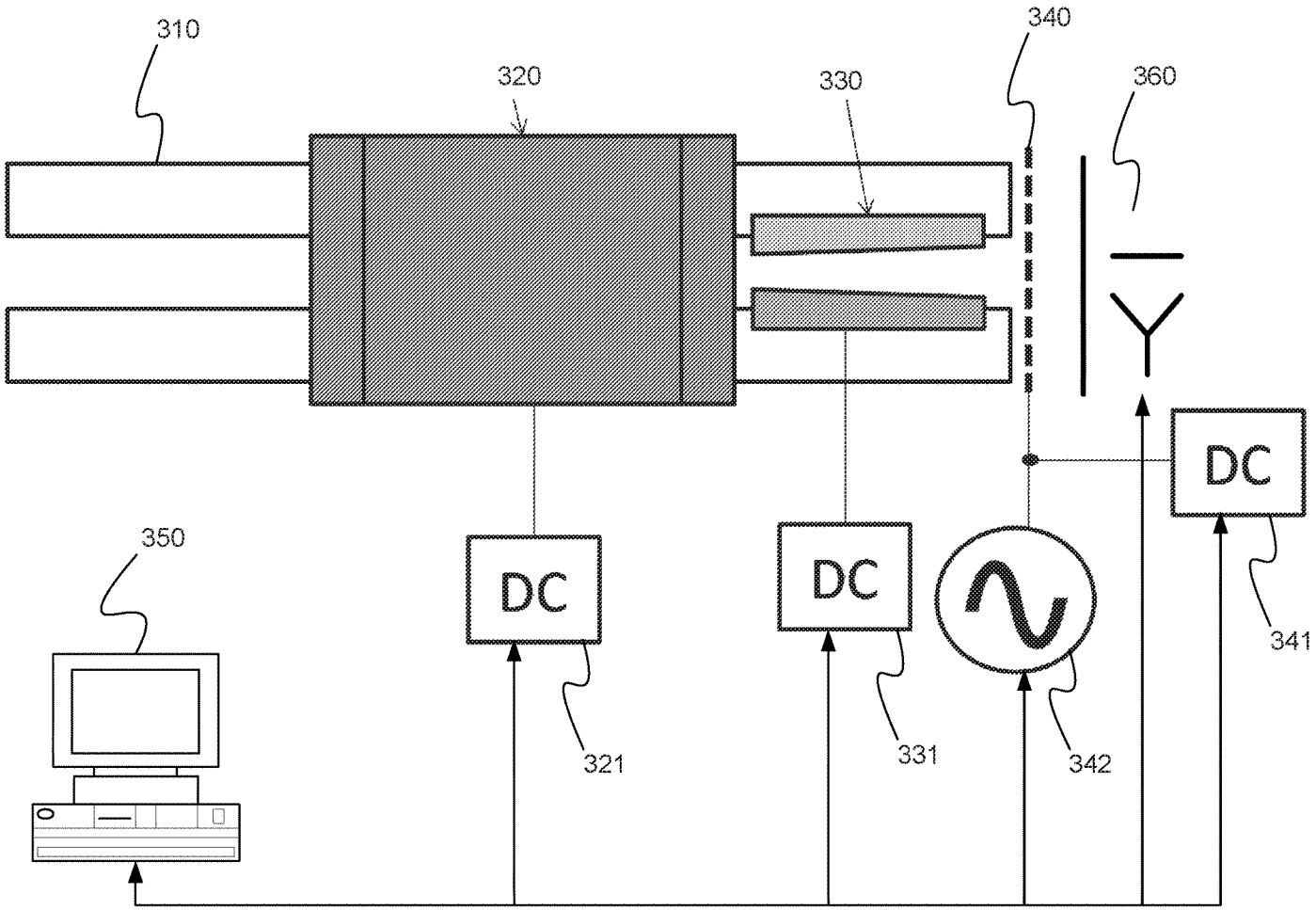
FIG. 3 is an exemplary schematic diagram of the electrodes of the Q3 quadrupole and an exit lens used to control the precise rate of axial ejection of coherently oscillating ions from the Q3 quadrupole to a detector, in accordance with various embodiments.

FIG. 3 is an exemplary schematic diagram 300 of the electrodes of the Q3 quadrupole and an exit lens used to control the precise rate of axial ejection of coherently oscillating ions from the Q3 quadrupole to a detector, in accordance with various embodiments. Initially, the ions are made to coherently oscillate by applying a dipolar excitation between X rods 310 using a toroidal transformer (not shown) connected between X rods 310. X rods 310 can also be called A pole rods, because these are the same rods used conventionally for mass-selective axial ejection.

In various embodiments, axial ejection of all coherently oscillated ions toward detector 360 is accomplished by appropriately adjusting the voltages of collar electrode 320 and linear accelerator (Linac) electrodes 330 of the Q3 quadrupole and the voltages of exit lens 340. The DC voltage of collar electrode 320 is adjusted by controlling DC voltage source 321, the DC voltage of Linac electrodes 330 are adjusted by controlling DC voltage source 331, and the DC and RF voltages of exit lens 340 are adjusted by controlling DC voltage source 341 and RF voltage source 342, respectively, for example. Note that the trapping field of exit lens 340 includes contributions from DC and RF voltages. Voltage sources 321, 331, 341, and 342 are controlled by processor 350, for example.

Figure 4:
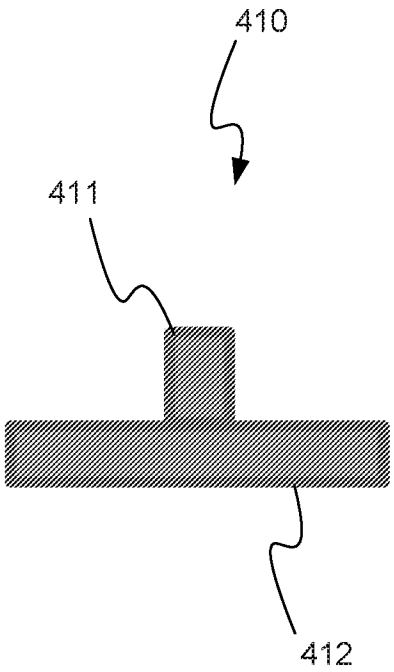
FIG. 4 is an exemplary axial view of a linear accelerator (Linac) electrode of a Q3 quadrupole, in accordance with various embodiments.

FIG. 4 is an exemplary axial view 400 of a Linac electrode 410 of a Q3 quadrupole, in accordance with various embodiments. Vertical portion 411 of Linac electrode 410 is placed between rods (not shown) of the Q3 quadrupole so that it is closer to the axis of the Q3 quadrupole than horizontal portion 412. Horizontal portion 412, therefore, lies outside of the circumference of the rods of the Q3 quadrupole.

Figure 5:
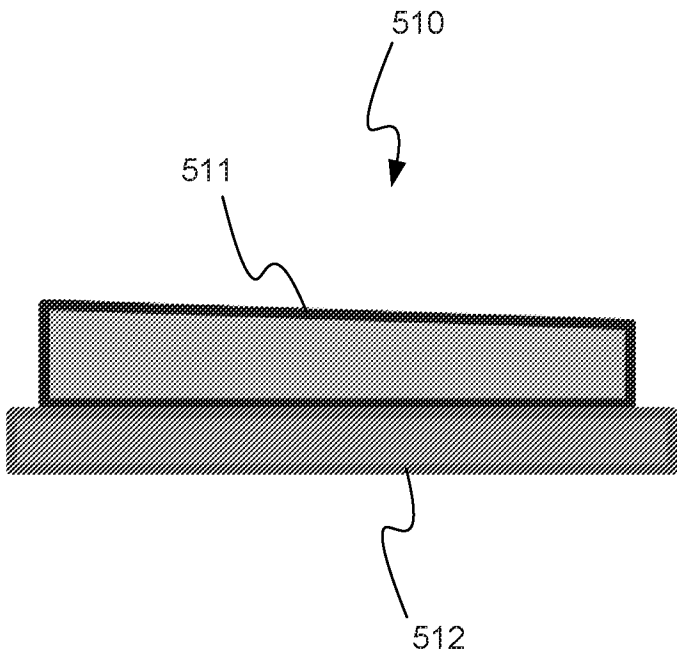
FIG. 5 is an exemplary side view of a Linac electrode of a Q3 quadrupole, in accordance with various embodiments.

FIG. 5 is an exemplary side view 500 of a Linac electrode 510 of a Q3 quadrupole, in accordance with various embodiments. FIG. 5 shows that the vertical height of vertical portion 511 of Linac electrode 510 is tapered along the direction of the axis of the Q3 quadrupole. Horizontal portion 512 of Linac does not vary in height or width along the direction of the axis of the Q3 quadrupole. Returning to FIG. 3, the vertical portions of Linac electrodes 330 are shown. In FIG. 3, the vertical portions of Linac electrodes 330 are also shown to taper along the axis of the Q3 quadrupole. Note that the vertical portions of Linac electrodes 330 taper so that they are further from the axis of the Q3 quadrupole as they get closer to exit lens 340. This tapering establishes an electric field component along the axis of the Q3 quadrupole that helps eject coherent oscillating ions axially.

Figure 6:
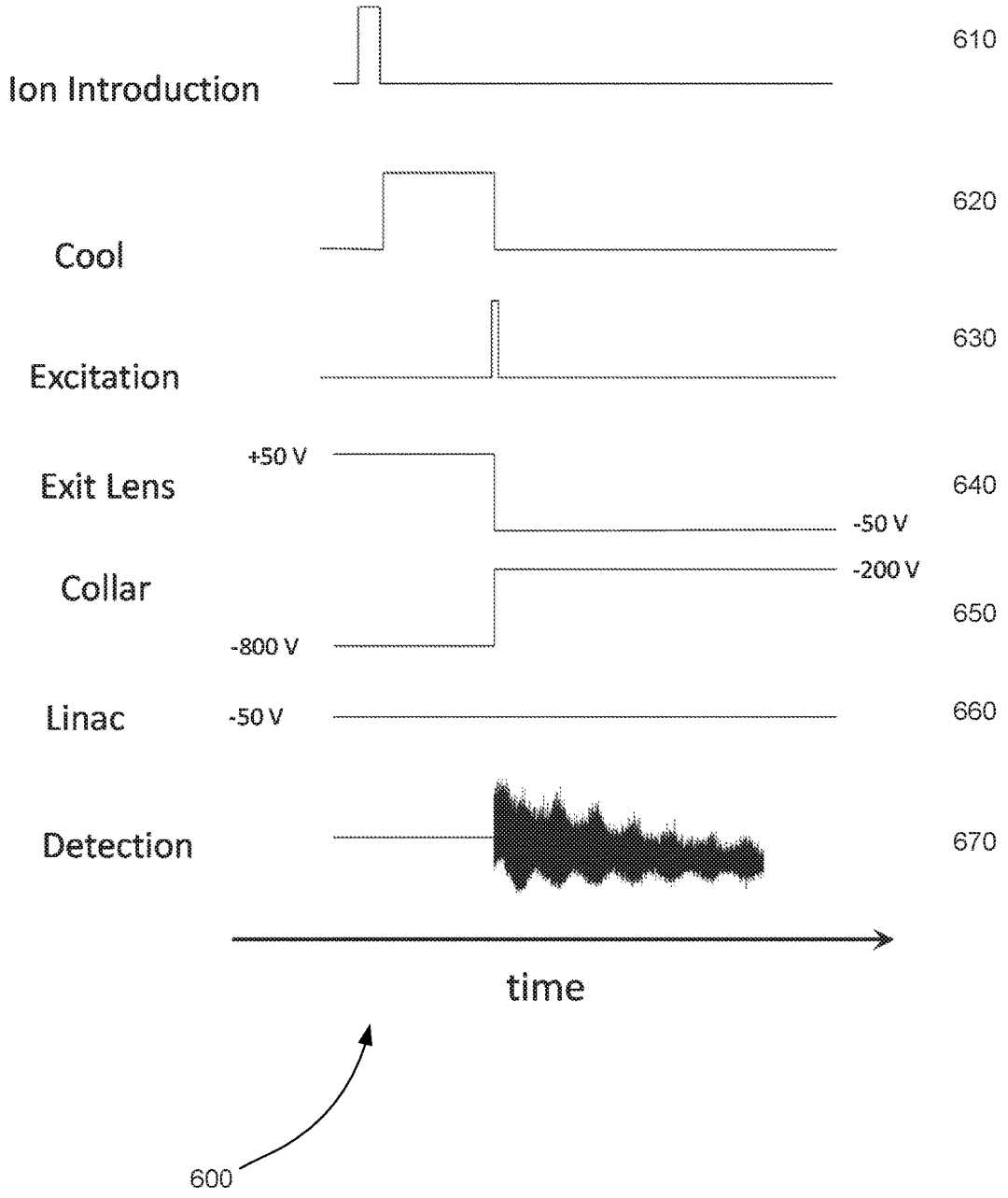
FIG. 6 is an exemplary series of timing diagrams that show how a linear ion trap (LIT) is controlled in order to perform FTMS, in accordance with various embodiments.

FIG. 6 is an exemplary series 600 of timing diagrams that show how a LIT is controlled in order to perform FTMS, in accordance with various embodiments. The LIT is controlled using a processor (not shown). Timing diagram 610 shows that product ions and residual selected precursor ions are introduced into the LIT over a period of time. This time period for ion introduction is on the order of 10 ms. After ions are introduced into the LIT or the LIT is filled with ions, the ions are cooled. Timing diagram 620 shows the time period for cooling ions. This time period for ion cooling is on the order of 50 ms. Once the ions are cooled, they can be excited.

Timing diagram 630 shows the narrow dipolar DC voltage excitation pulse used to oscillate the ions in the LIT. Because time and frequency are inversely proportional, a narrower excitation pulse in the time domain produces a wider frequency spectrum. A wider frequency spectrum means that a wider m/z range of ions can be excited by the same pulse. As described above, the narrow dipolar DC voltage excitation pulse is applied between X rods of the LIT. The dipolar DC voltage excitation pulse of timing diagram 630 has an amplitude of between ±5V and ±40 V and a width of between 1 and 5 μs, for example.

After all the ions in the LIT are excited by the excitation pulse, they are axially ejected. As described above, simply ejecting all the ions quickly and destructively detecting them once would not provide a signal of sufficient duration to provide a high enough resolution. As a result, the voltages of the electrodes of the LIT and the exit lens are controlled to meter out the ions of LIT over a period of time.

Timing diagram 640 shows the change in the DC voltage of the exit lens immediately after the excitation pulse. The DC voltage is changed from +50 V to −50 V, for example, for positive ions. This change causes positive ions to be more attracted to the exit lens. This voltage, however, is still made to be more positive than the voltage of the collar electrode of the LIT. This prevents all of the ions from immediately exiting the LIT.

Timing diagram 650 shows the change in the DC voltage of the collar electrode of the LIT immediately after the excitation pulse. The DC voltage is changed from −800 V to −200 V, for example, for positive ions. This more positive change in negative voltage makes the positive ions less attracted to the LIT and more likely to leave the LIT. However, because −200 V is still more negative than the −50 V of the exit lens, a barrier remains so that the positive ions do not leave the LIT immediately.

Timing diagram 660 shows that the voltage of the Linac electrodes of the LIT do not change. The DC voltage of the Linac electrodes is −50 V before and after the excitation pulse. Due to the tapering of the Linac electrodes, shown in FIGS. 3 and 5, the constant DC voltage of the Linac electrodes produces an electric field component along the axis of the LIT. This electric field component accelerates ions axially toward the exit lens. Because the DC voltage of the Linac electrodes does not change after the excitation pulse, the acceleration of ions takes place before and after the excitation pulse.

Ions are not ejected from the LIT before the excitation pulse, because the voltage of the exit lens is much more positive than the voltage of the Linac electrodes. After the excitation pulse, however, the exit lens is given the same voltage as the Linac electrodes. This causes ions to be ejected, because there is no longer any voltage barrier for the ions accelerated by the electric field component produced by the Linac electrodes.

In summary, the axial electric field component produced by the DC voltage applied to the Linac electrodes directs positive ions axially from the collar electrode of the LIT to the exit lens. Few positive ions are accelerated from the LIT near the collar electrode by the Linac electrodes before the excitation pulse, because the collar electrode has a voltage that is so much more negative than the Linac electrodes. Also, even those positive ions that are accelerated by the Linac electrodes before the excitation pulse are not ejected, because the exit lens has a voltage that is so much more positive than the Linac electrodes.

After the excitation pulse, however, the voltage of the collar electrode is made more positive, and the voltage of the exit lens is given the same voltage as the Linac electrodes. These changes in voltage allow more positive ion to be accelerated from the LIT near the collar electrode by the Linac electrodes after the excitation pulse. They also allow those positive ions that are accelerated by the Linac electrodes after the excitation pulse to be ejected through the exit lens. Again, the positive ions are not immediately accelerated and ejected by the axial electric field component produced by the Linac electrodes after the excitation pulse, because the voltage of the collar electrode is still more negative than the Linac electrodes and the exit lens. As a result, the positive ions are metered out over time.

Timing diagram 670 shows the ion signal detected by the detector. This diagram shows that no ions are detected before the excitation pulse. After the excitation pulse, however, many different ion oscillations are detected. In addition, these oscillations are detected over a period of time. These oscillations are detected for between 15 and 30 ms, for example. Such a time period provides enough signal to provide a high resolution mass spectrum typical of conventional FTMS instruments. In addition, timing diagrams 610, 620, 630, and 670 show that this type of LIT FTMS has a total overall acquisition time equal to or better than conventional FTMS instruments. For example, the total acquisition time is between 60 and 90 ms including ion filling and cooling times. Without ion filling and cooling times, the acquisition time is between 15 and 30 ms.

Figure 7:
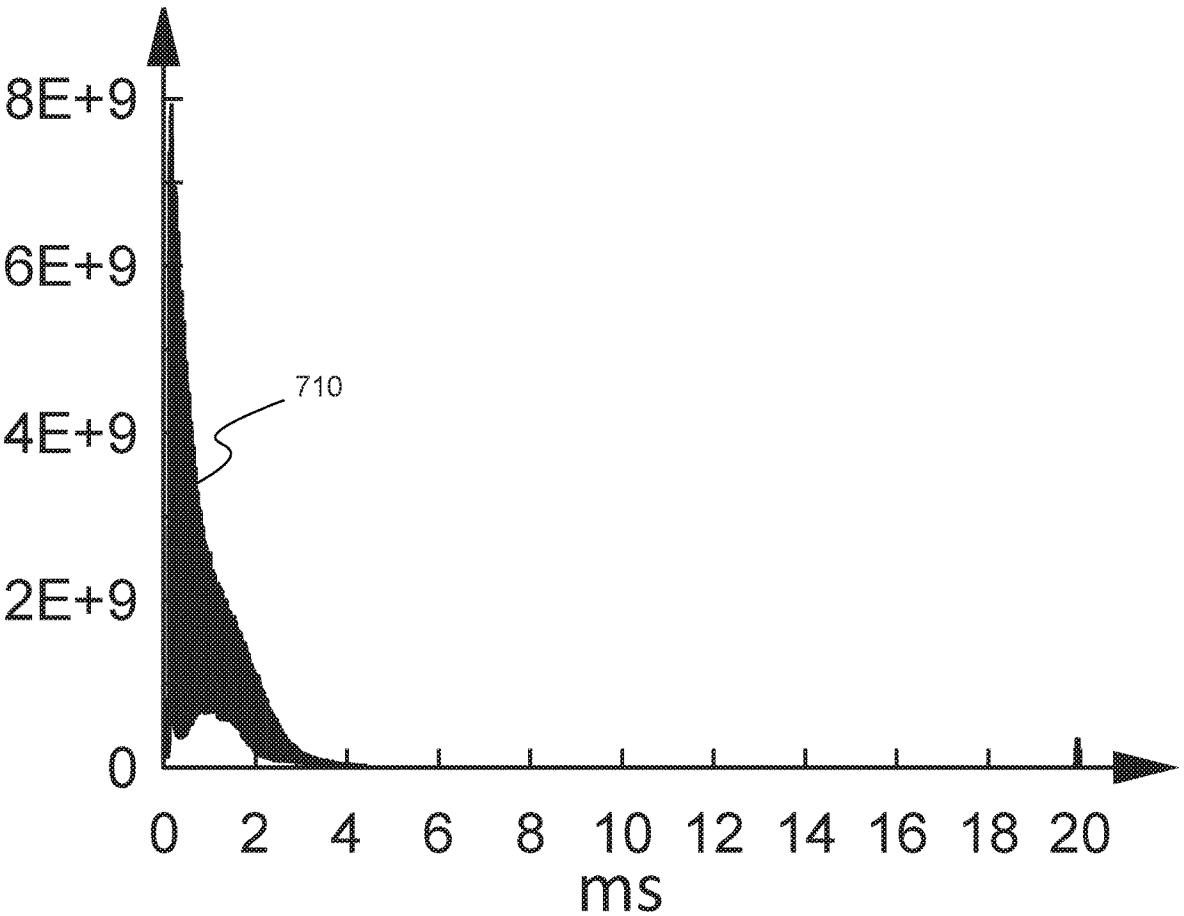
FIG. 7 is an exemplary plot of detected intensities of coherently oscillating ions ejected over a period of 3 ms from a LIT that performs FTMS, in accordance with various embodiments.

FIG. 7 is an exemplary plot 700 of detected intensities of coherently oscillating ions ejected over a period of 3 ms from a LIT that performs FTMS, in accordance with various embodiments. The detected intensities of coherently oscillating ions are represented by ion decay signal 710. The short 3 ms time period of ion decay signal 710 produces a poor frequency resolution after a Fourier transform is applied to ion decay signal 710. The short time period of ion decay signal 710 was produced by a poor selection of voltages for the collar electrode and the plurality of Linac electrodes of the LIT and for the exit lens, for example.

Figure 8:
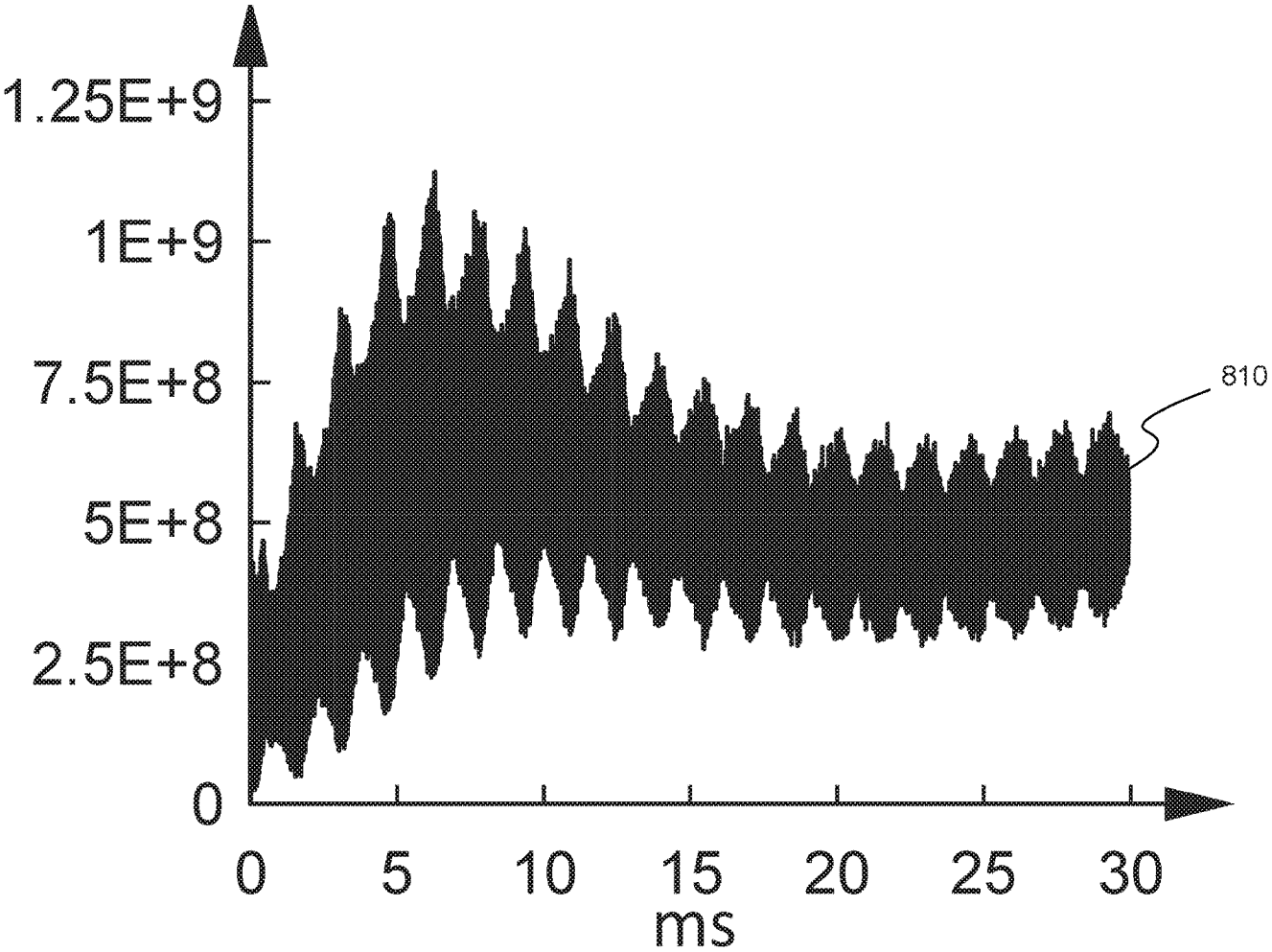
FIG. 8 is an exemplary plot of detected intensities of coherently oscillating ions ejected over a period of 30 ms from a LIT that performs FTMS, in accordance with various embodiments.

FIG. 8 is an exemplary plot 800 of detected intensities of coherently oscillating ions ejected over a period of 30 ms from a LIT that performs FTMS, in accordance with various embodiments. The detected intensities of coherently oscillating ions are represented by ion decay signal 810. The time period of ion decay signal 810 is about ten times longer than the time period of ion decay signal 710 in FIG. 7. This longer time period produces a good frequency resolution after a Fourier transform is applied to ion decay signal 810. The long time period of ion decay signal 810 was produced by a correct selection of voltages for the collar electrode and the plurality of Linac electrodes of the LIT and for the exit lens, for example.

Figure 9:
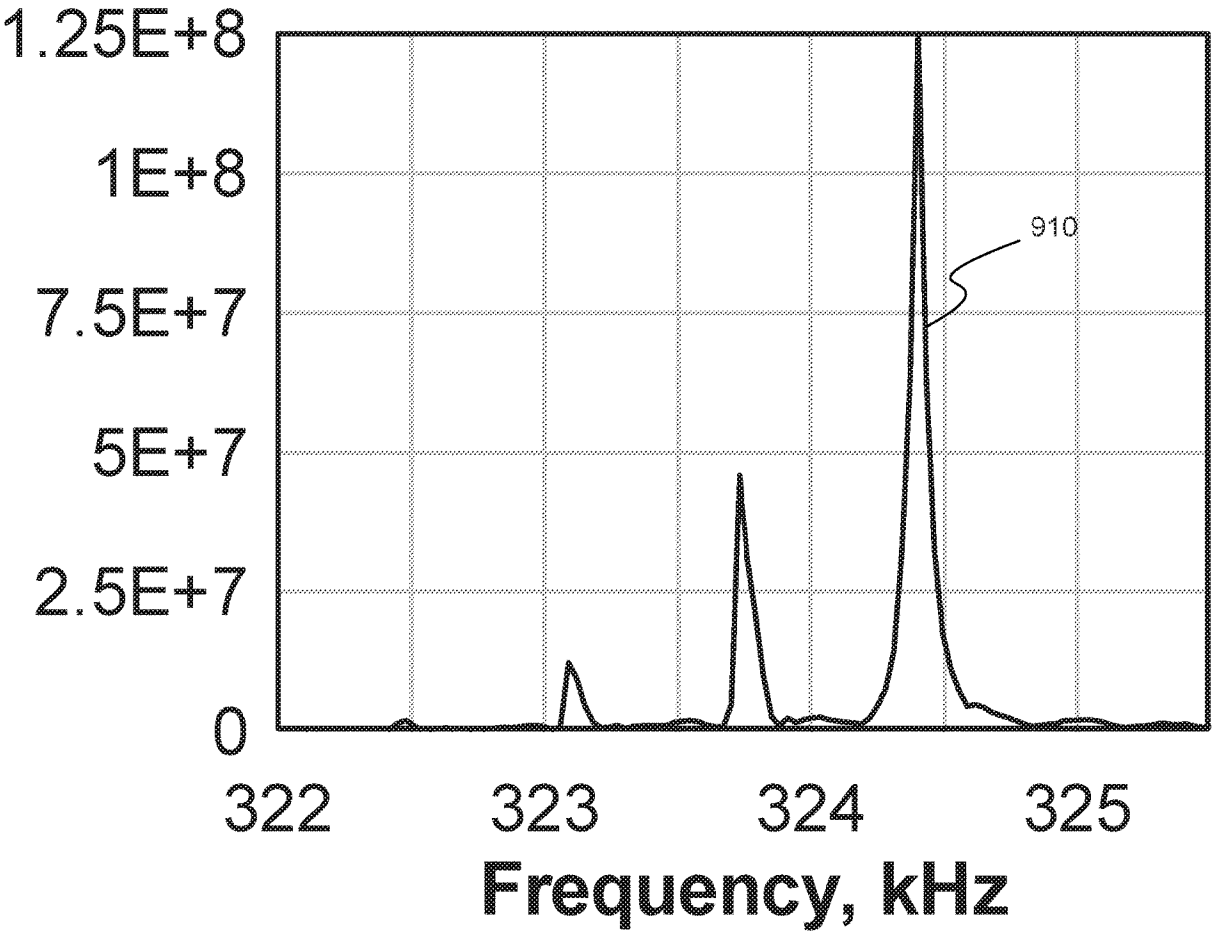
FIG. 9 is an exemplary plot of a portion of the frequency spectrum obtained by applying a Fourier transform to the ion decay signal of FIG. 8, in accordance with various embodiments.

FIG. 9 is an exemplary plot 900 of a portion of the frequency spectrum obtained by applying a Fourier transform to the ion decay signal 810 of FIG. 8, in accordance with various embodiments. The portion of the frequency spectrum shown in FIG. 9 shows that good frequency resolution is obtained from ion decay signal 810 of FIG. 8. In fact, the peaks of the portion of the frequency spectrum shown in FIG. 9, such as peak 910 are as wide as 80 Hz. A high resolution mass spectrum can be obtained from a high resolution frequency spectrum.

In order to verify that a LIT can successfully perform FTMS using a dipolar DC voltage excitation pulse and destructive detection, reserpine precursor ions with an m/z of 609 were selected in a Q1 quadrupole of a triple quadrupole with a 3 amu precursor ion mass selection window and fragmented in the Q2 collision cell of the triple quadrupole with 35 eV collision energy.

Product ions of reserpine and residual precursor ions were then trapped and cooled in the Q3 quadrupole of the triple quadrupole, which was configured as a LIT. The chamber pressure of the Q3 quadrupole was $2.3\times10^{-5}$ torr. A 6 V square wave dipolar DC voltage excitation pulse with a width of 1.5 μs was applied to the product ions of reserpine and the residual precursor ions. The excitation pulse caused the ions to coherent oscillate in the Q3 quadrupole. The DC voltage of the collar electrode of the Q3 quadrupole and the DC voltage of the exit lens were then changed to eject the coherently oscillating ions for a period of more than 15 ms from the Q3 quadrupole. The ejected coherently oscillating ions were destructively detected by a detector and recorded.

Figure 10:
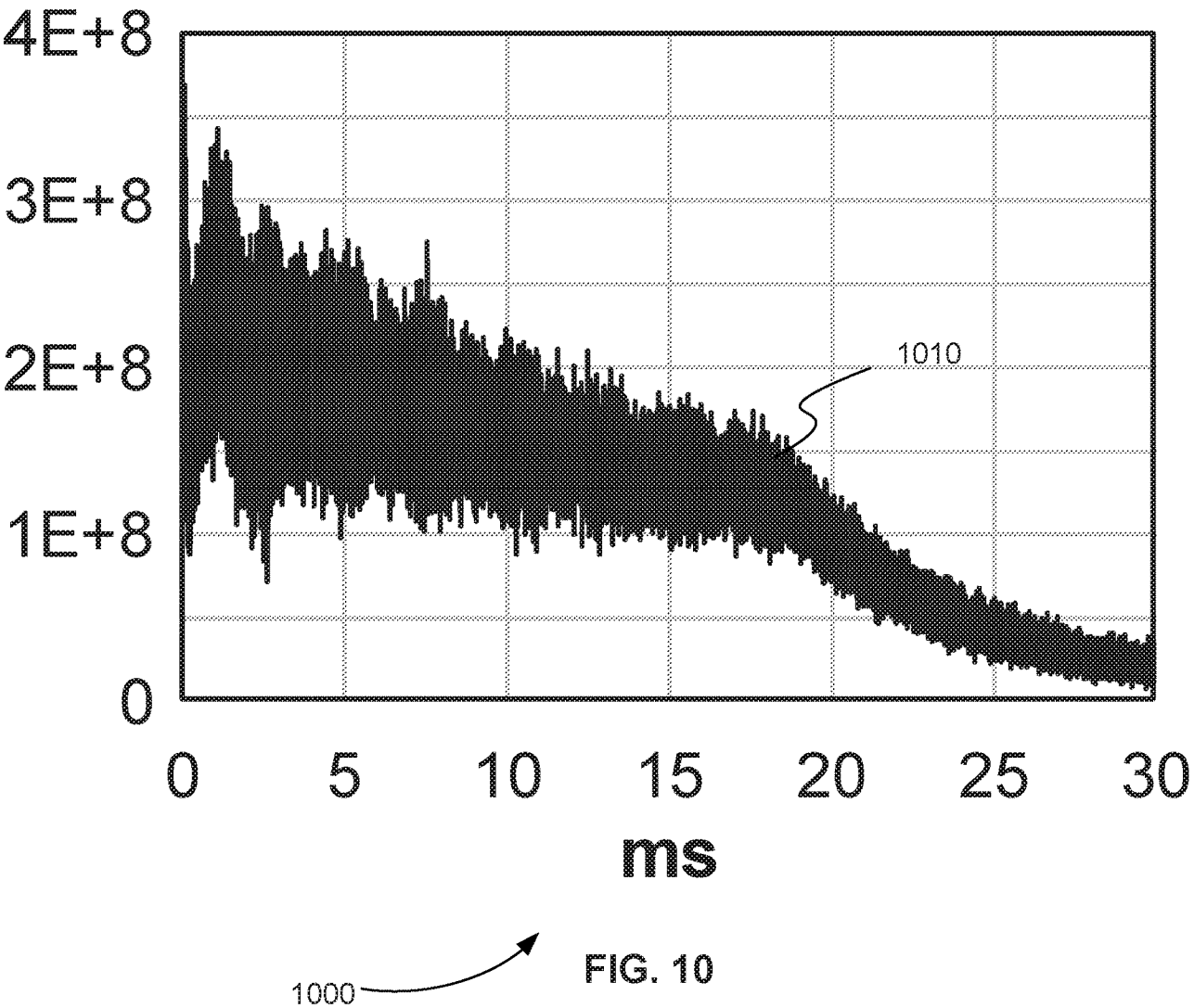
FIG. 10 is an exemplary plot of detected intensities of coherently oscillating product ions and residual precursor ions of reserpine ejected over a period of 30 ms from a LIT that performs FTMS, in accordance with various embodiments.

FIG. 10 is an exemplary plot 1000 of detected intensities of coherently oscillating product ions and residual precursor ions of reserpine ejected over a period of 30 ms from a LIT that performs FTMS, in accordance with various embodiments. FIG. 10 shows that ion decay signal 1010 of the product ions and residual precursor ions of reserpine maintain coherence for more than 15 ms.

Figure 11:
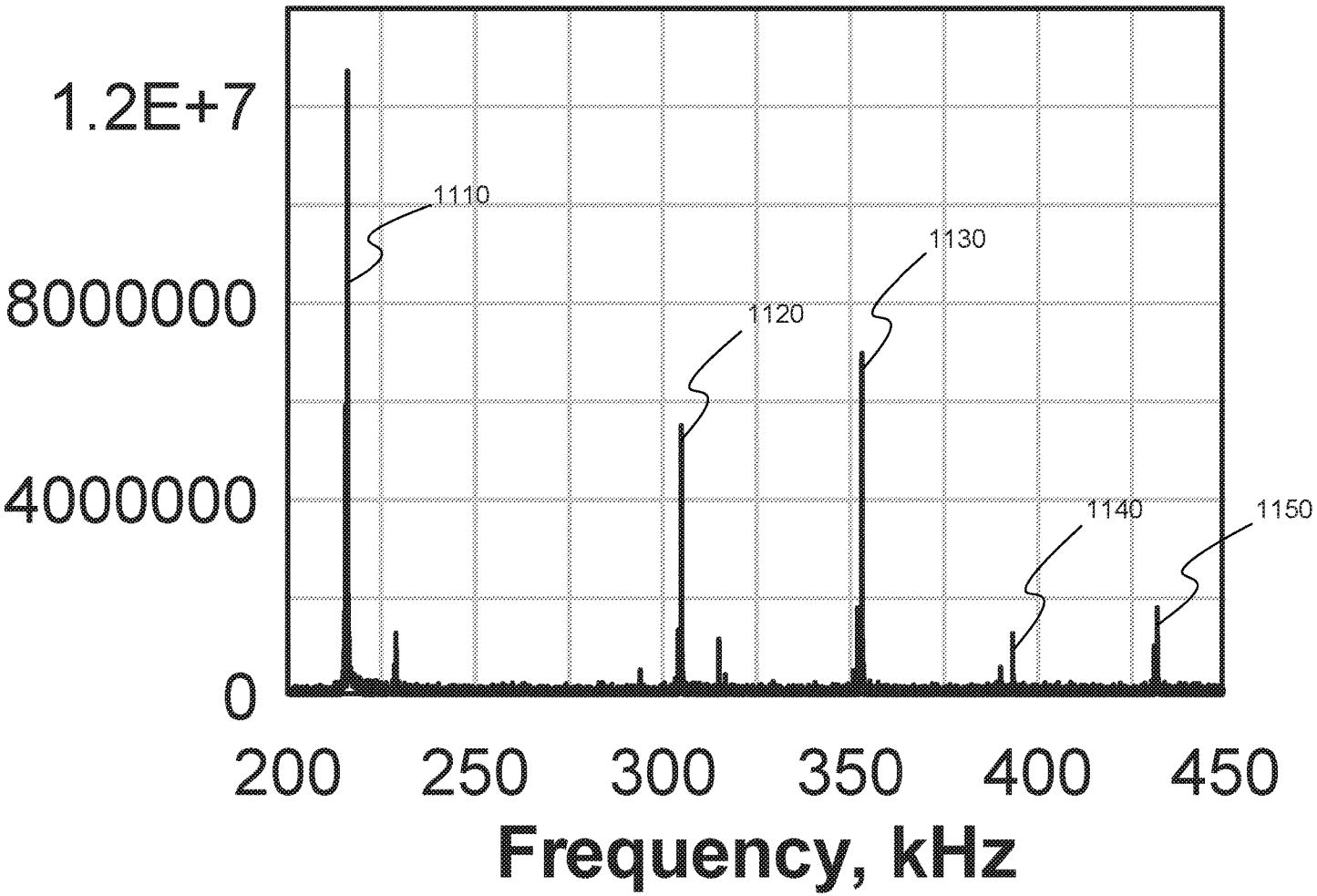
FIG. 11 is an exemplary plot of the frequency spectrum obtained by applying a Fourier transform to the ion decay signal of FIG. 10, in accordance with various embodiments.

FIG. 11 is an exemplary plot 1100 of the frequency spectrum obtained by applying a Fourier transform to the ion decay signal 1010 of FIG. 10, in accordance with various embodiments. The frequency spectrum of FIG. 11 shows that the product ions and residual precursor ions of reserpine have been obtained. Peak 1110 at 215.8 kHz corresponds to an m/z of 609, which is the m/z of the reserpine precursor ion. Peak 1120 at 305.0 kHz corresponds to an m/z of 448, which is the m/z of a product ion of reserpine. Peak 1130 at 353.0 kHz corresponds to an m/z of 397, which is the m/z of a product ion of reserpine. Peak 1140 at 393.0 kHz corresponds to an m/z of 364, which is the m/z of a product ion of reserpine. Peak 1150 at 431.7 kHz corresponds to twice the frequency of the reserpine precursor ion.

Figure 12:
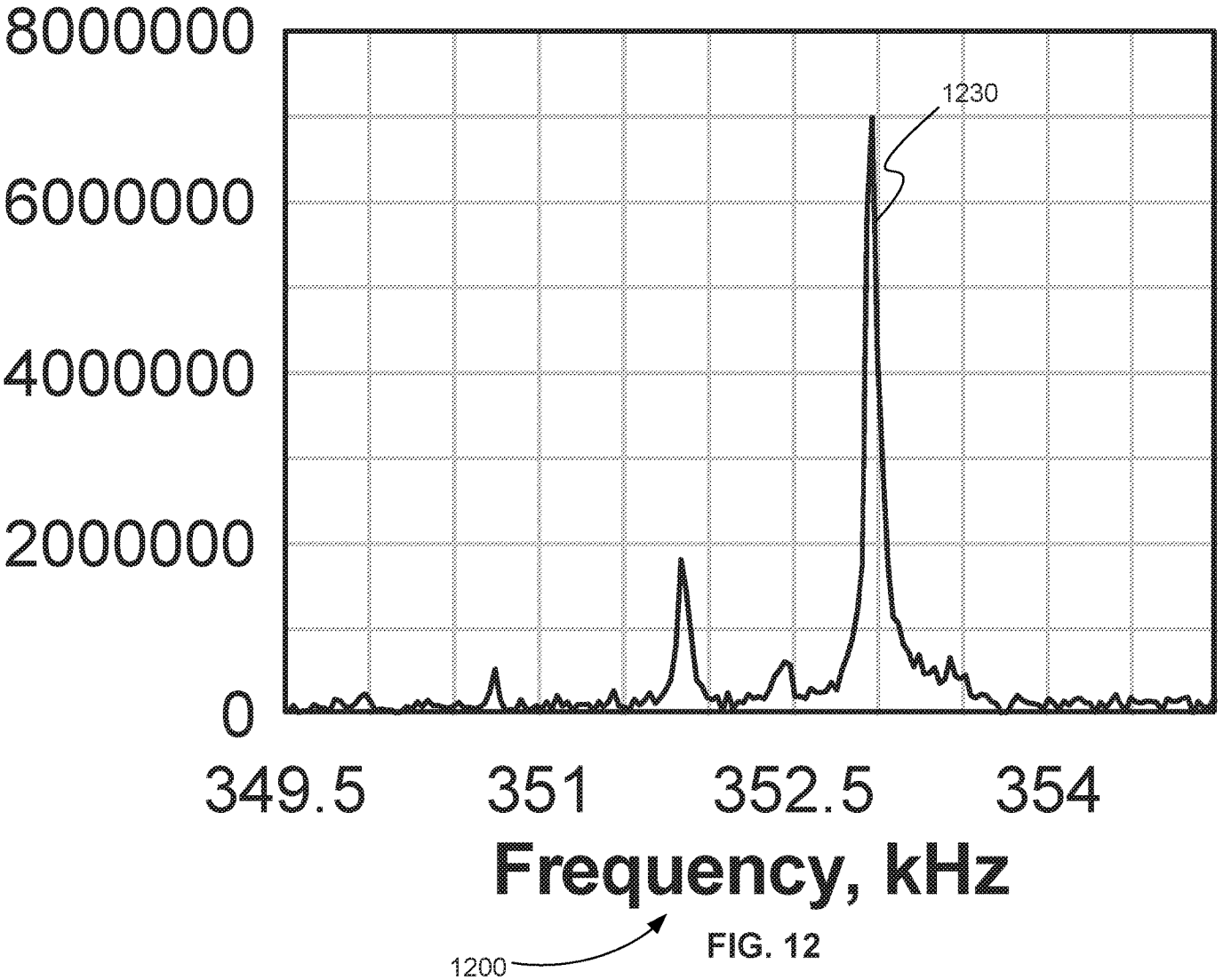
FIG. 12 is an exemplary plot of a magnified portion of the frequency spectrum of FIG. 11 between 349.5 kHz and 355.5 kHz, in accordance with various embodiments.

FIG. 12 is an exemplary plot 1200 of a magnified portion of the frequency spectrum of FIG. 11 between 349.5 kHz and 355.5 kHz, in accordance with various embodiments. This magnified portion of the frequency spectrum of FIG. 11 shows that the resolution of frequency peaks corresponding to ions is on the order of 70-80 Hz (full width at half maximum). For example, peak 1230 at 353.0 kHz corresponds to an m/z of 397, which is the m/z of a product ion of reserpine.

System for Exciting and Ejecting Ions for Destructive FTMS

Returning to FIG. 3, system 300 is a system for coherently exciting and ejecting ions for destructive FTMS mass analysis, in accordance with various embodiments. System 300 includes a quadrupole, exit lens 340, destructive detector 360 and processor 350. The quadrupole includes quadrupole rods 310 and a plurality of auxiliary electrodes. Quadrupole rods 310 have an entrance end for receiving ions and an exit end for ejecting ions.

In various embodiments, the plurality of auxiliary electrodes include collar electrode 320 and plurality of Linac electrodes 330. Collar electrode 320 surrounds the central portion of quadrupole rods 310. Plurality of Linac electrodes 330 are located near the exit end of quadrupole rods 310. In various alternative embodiments, the plurality of auxiliary electrodes includes a single set of auxiliary electrodes. For example, the plurality of auxiliary electrodes can just include plurality of Linac electrodes 330.

Exit lens 340 is located coaxially with quadrupole rods 310 near the exit end of quadrupole rods 310. Destructive detector 360 is located coaxially with exit lens 340 and is located on the other side of exit lens 340.

Processor 350 can be, but is not limited to, a computer, microprocessor, or any device capable of sending and receiving control signals and processing data. Processor 350 can be, for example, computer system 100 of FIG. 1. In various embodiments, processor 350 is in communication with the quadrupole, exit lens 340 and destructive detector 360.

In order to fill the quadrupole with ions and cool the ions once filled, processor 350 applies a pressure and gas flow within the quadrupole by controlling gas inlets and outlets (not shown) of the quadrupole. Processor 350 controls the gas inlets and outlets of the quadrupole to apply the pressure within the quadrupole at a value between $0.5\times10^{-5}$ and $5\times10^{-5}$ torr, for example.

In order to trap the ions in the quadrupole during the filling and cooling, processor 350 applies a direct current (DC) voltage and a radio frequency (RF) voltage to quadrupole rods 310, one or more DC voltages to the plurality of auxiliary electrodes, and a DC voltage and an RF voltage to exit lens 340. For example, processor 350 applies the DC voltage to quadrupole rods 310 by controlling a DC voltage source (not shown) and applies the RF voltage to quadrupole rods 310 by controlling an RF voltage source (not shown). Processor 350 applies the DC voltage to exit lens 340 by controlling DC voltage source 341 and the RF voltage to exit lens 340 by controlling RF voltage source 342.

In various embodiments, in order to trap the ions in the quadrupole during the filling and cooling, processor applies one or more DC voltages to the plurality of auxiliary electrodes by applying a DC voltage to collar electrode 320 and a DC voltage to plurality of Linac electrodes 330. Processor 350 applies the DC voltage to collar electrode 320 by controlling DC voltage source 321, for example. Processor 350 applies the DC voltage to plurality of Linac electrodes 330 by controlling DC voltage source 331, for example.

In order to coherently oscillate the ions after the filling and cooling, processor 350 applies a coherent excitation between at least two rods of quadrupole rods 310. In various embodiments, the coherent excitation applied between at least two rods of quadrupole rods 310 is a dipolar DC excitation pulse voltage. Processor 350 applies the dipolar DC excitation pulse voltage to the at least two rods by controlling a frequency generator (not shown) and a toroidal transformer (not shown) placed between the at least two rods, for example. Processor applies the dipolar DC excitation pulse voltage with a pulse width between 0.5 to 5 μs, for example.

In order to axially eject the coherently oscillating ions through exit lens 340 and to destructive detector 360 for detection after the coherent excitation is applied, processor 350 changes one or more voltages of the one or more DC voltages of the plurality of auxiliary electrodes and changes the DC voltage of exit lens 340. In various embodiments, processor changes one or more voltages of the one or more DC voltages of the plurality of auxiliary electrodes by changing the DC voltage of collar electrode 320. Processor 350 changes the DC voltage of collar electrode 320 by controlling DC voltage source 321, for example.

Processor 350 changes the one or more voltages of the one or more DC voltages of the plurality of auxiliary electrodes and changes the DC voltage of exit lens 340 so that the coherently oscillating ions are ejected fast enough to prevent the loss of coherence, but slow enough to provide the coherently oscillating ions to destructive detector 360 over a period time long enough to calculate a high resolution spectrum from the coherently oscillating ions, for example. In various, embodiments, processor 350 changes the DC voltage of collar electrode 320 and changes the DC voltage of exit lens 340 so that the coherently oscillating ions are ejected through exit lens and to destructive detector 360 over a time period of between 15 and 30 ms.

In various embodiments, in order to trap positive ions in the quadrupole during the filling and cooling, processor 350 applies a first DC Linac voltage to plurality of Linac electrodes 330, a first DC collar voltage to collar electrode 320 that is more negative than the first DC Linac voltage, and a first DC exit lens voltage to exit lens 340 that is more positive than the first DC Linac voltage. In order to axially eject the coherently oscillating positive ions through exit lens 340 and to destructive detector 360 for detection after the coherent excitation is applied, processor 350 changes the DC voltage of collar electrode 320 from the first DC collar voltage to a second DC collar voltage and changes the DC voltage of exit lens 340 from the first DC exit lens voltage to a second exit lens voltage. The second DC collar voltage is less negative than the first DC collar voltage, but still more negative than the first Linac voltage. The second exit lens voltage is the same as the first Linac voltage.

In order to trap negative ions in the quadrupole during the filling and cooling, processor 350 applies a first DC Linac voltage to plurality of Linac electrodes 330, a first DC collar voltage to collar electrode 320 that is more positive than the first DC Linac voltage, and a first DC exit lens voltage to exit lens 340 that is more negative than the first DC Linac voltage. In order to axially eject the coherently oscillating negative ions through exit lens 340 and to destructive detector 360 for detection after the coherent excitation is applied, processor 350 changes the DC voltage of collar electrode 320 from the first DC collar voltage to a second DC collar voltage and changes the DC voltage of exit lens 340 from the first DC exit lens voltage to a second exit lens voltage. The second DC collar voltage is less positive than the first DC collar voltage, but still more positive than the first Linac voltage. The second exit lens voltage is the same as the first Linac voltage.

In various embodiments, the a radial dimension of each Linac electrode of plurality of Linac electrodes 330 is tapered along the axis of the quadrupole so that a component of the electric field produced by the DC voltage applied to plurality of Linac electrodes 330 axially accelerates the coherently oscillating ions towards the exit end of quadrupole rods 310.

In various embodiments, processor 350 further records in a memory over a period of time intensities produced by destructive detector 360 as the coherently oscillating ions hit destructive detector 360. Processor 350 converts the intensities recorded over the period of time to a frequency spectrum using a Fourier transform. Processor 350 calculates a mass spectrum of the coherently oscillating ions from the frequency spectrum.

Method for Exciting and Ejecting Ions for Destructive FTMS

Figure 13:
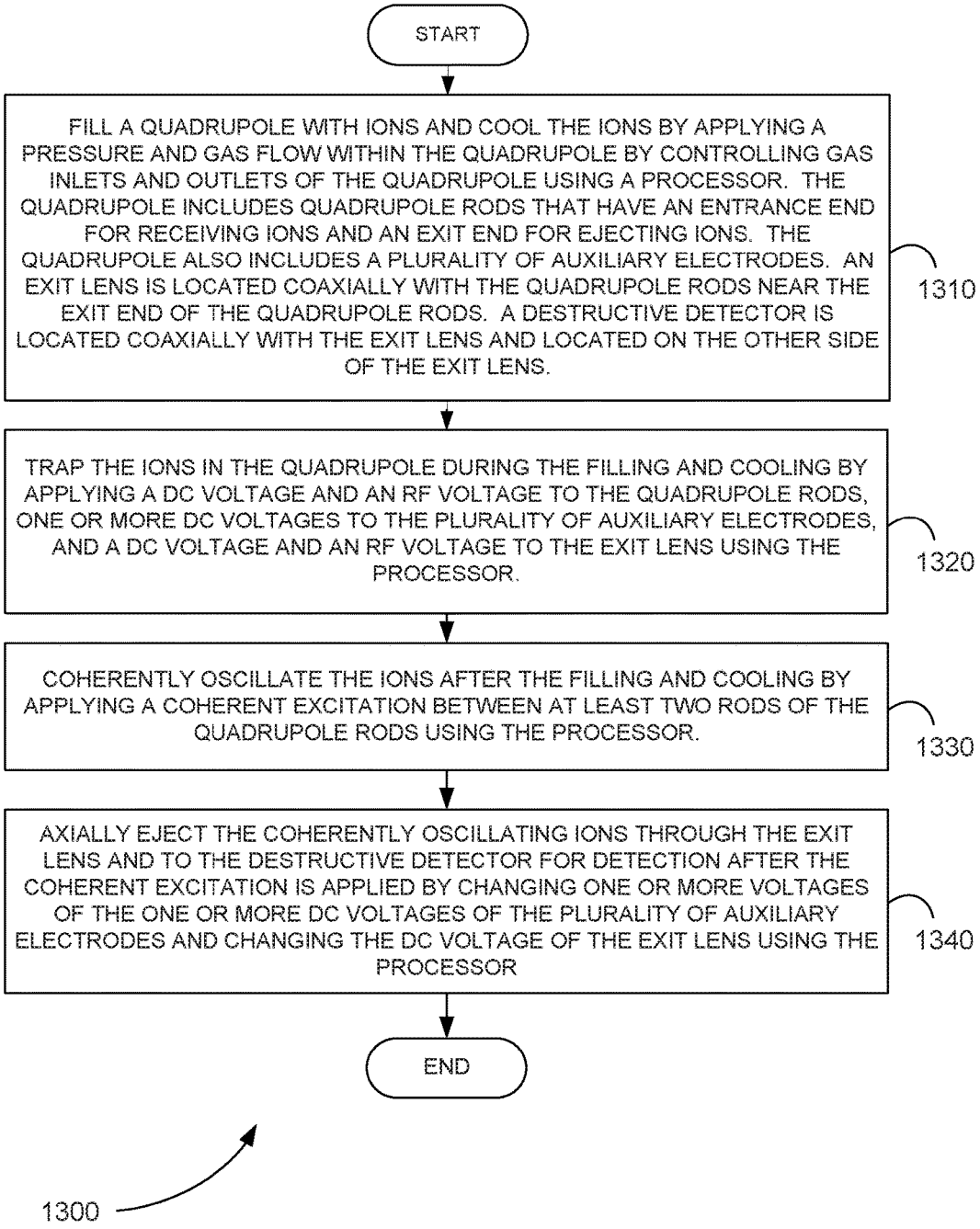
FIG. 13 is a flowchart showing a method for coherently exciting and ejecting ions for destructive FTMS mass analysis using a LIT quadrupole, in accordance with various embodiments.

FIG. 13 is a flowchart showing a method 1300 for coherently exciting and ejecting ions for destructive FTMS mass analysis using a LIT quadrupole, in accordance with various embodiments.

In step 1310 of method 1300, a quadrupole is filled with ions and the ions are cooled by applying a pressure and gas flow within the quadrupole by controlling gas inlets and outlets of the quadrupole using a processor. The quadrupole includes quadrupole rods that have an entrance end for receiving ions and an exit end for ejecting ions. The quadrupole also includes a plurality of auxiliary electrodes. An exit lens is located coaxially with the quadrupole rods near the exit end of the quadrupole rods. A destructive detector is located coaxially with the exit lens and located on the other side of the exit lens.

In step 1320, the ions are trapped in the quadrupole during the filling and cooling by applying a DC voltage and an RF voltage to the quadrupole rods, one or more DC voltages to the plurality of auxiliary electrodes, and a DC voltage and an RF voltage to the exit lens using the processor.

In step 1330, the ions are coherently oscillated after the filling and cooling by applying a coherent excitation between at least two rods of the quadrupole rods using the processor.

In step 1340, the coherently oscillating ions are axially ejected through the exit lens and to the destructive detector for detection after the coherent excitation is applied by changing one or more voltages of the one or more DC voltages of the plurality of auxiliary electrodes and changing the DC voltage of the exit lens using the processor.

Computer Program Product for Exciting and Ejecting Ions for Destructive FTMS

In various embodiments, computer program products include a tangible computer-readable storage medium whose contents include a program with instructions being executed on a processor so as to perform a method for coherently exciting and ejecting ions for destructive FTMS mass analysis using a LIT quadrupole. This method is performed by a system that includes one or more distinct software modules.

Figure 14:
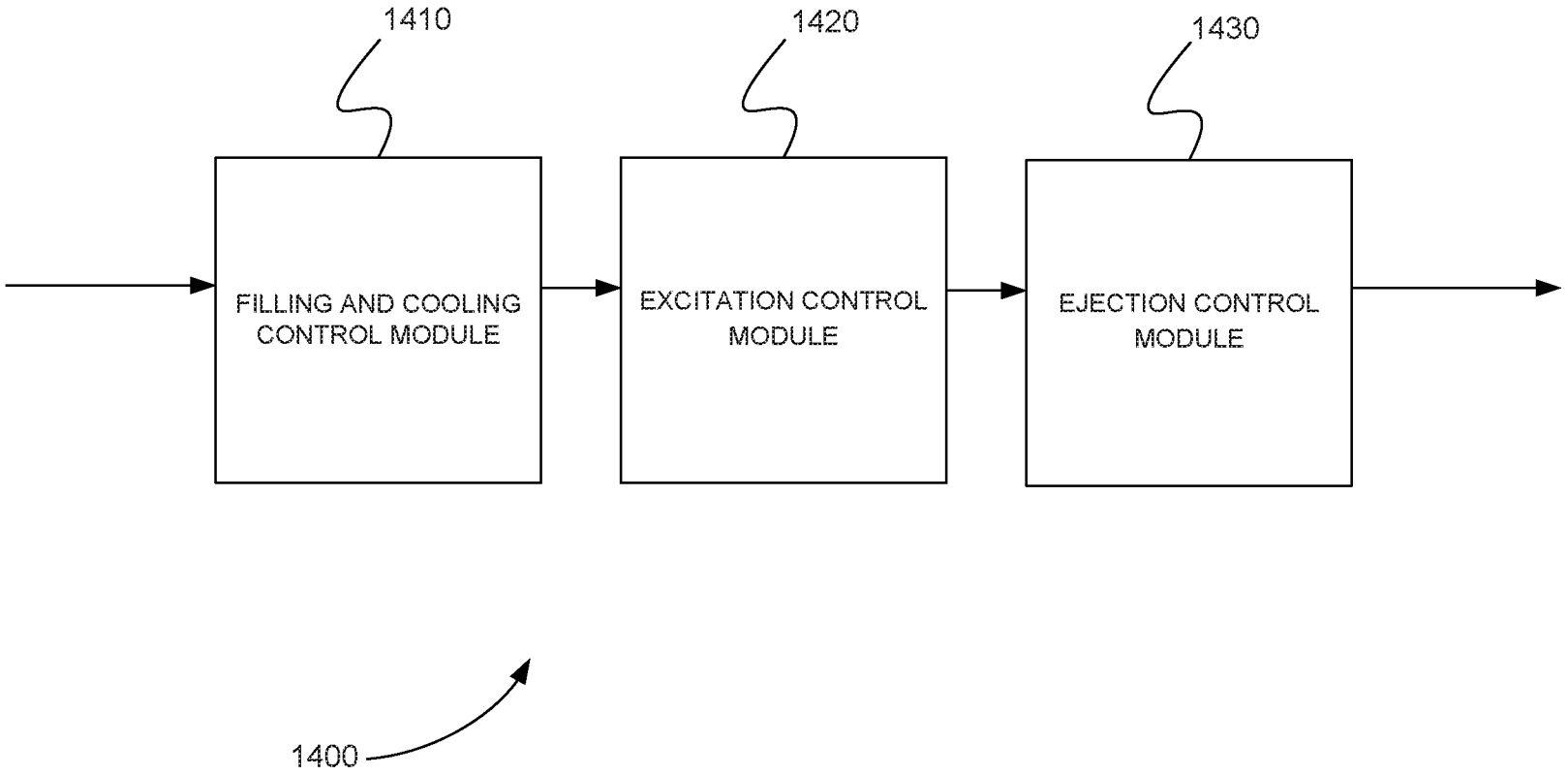
FIG. 14 is a schematic diagram of a system that includes one or more distinct software modules that performs a method for coherently exciting and ejecting ions for destructive FTMS mass analysis using a LIT quadrupole, in accordance with various embodiments.

FIG. 14 is a schematic diagram of a system 1400 that includes one or more distinct software modules that performs a method for coherently exciting and ejecting ions for destructive FTMS mass analysis using a LIT quadrupole, in accordance with various embodiments. System 1400 includes filling and cooling control module 1410, excitation control module 1420, and ejection control module 1430.

Filling and cooling control module 1410 fills a quadrupole with ions and cools the ions by applying a pressure and gas flow within the quadrupole by controlling gas inlets and outlets of the quadrupole. The quadrupole includes quadrupole rods that have an entrance end for receiving ions and an exit end for ejecting ions. The quadrupole also includes a plurality of auxiliary electrodes. An exit lens is located coaxially with the quadrupole rods near the exit end of the quadrupole rods. A destructive detector is located coaxially with the exit lens and located on the other side of the exit lens.

Filling and cooling control module 1410 traps the ions in the quadrupole during the filling and cooling by applying a DC voltage and a radio frequency RF voltage to the quadrupole rods, one or more DC voltages to the plurality of auxiliary electrodes, and a DC voltage and an RF voltage to the exit lens.

Excitation control module 1420 coherently oscillates the ions after the filling and cooling by applying a coherent excitation between at least two rods of the quadrupole rods. Ejection control module 1430 axially ejects the coherently oscillating ions through the exit lens and to the destructive detector for detection after the coherent excitation is applied by changing one or more voltages of the one or more DC voltages of the plurality of auxiliary electrodes and changing the DC voltage of the exit lens.

While the present teachings are described in conjunction with various embodiments, it is not intended that the present teachings be limited to such embodiments. On the contrary, the present teachings encompass various alternatives, modifications, and equivalents, as will be appreciated by those of skill in the art. Especially, it should be noted that, although the current embodiments incorporate collar electrodes and Linac electrodes, other combinations of auxiliary electrodes can be used to meter out the coherently excited ions within the linear ion trap.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for exciting and ejecting ions for destructive Fourier transform mass spectrometry (FTMS) mass analysis using a linear ion trap (LIT) quadrupole, comprising:

a quadrupole that includes quadrupole rods that have an entrance end for receiving ions and an exit end for ejecting ions and a plurality of auxiliary electrodes;

an exit lens located coaxially with the quadrupole rods near the exit end of the quadrupole rods;

a destructive detector located coaxially with the exit lens and located on the other side of the exit lens; and a processor in communication with the quadrupole, the exit lens, and the destructive detector that in order to fill the quadrupole with ions and cool the ions once filled, applies a pressure and gas flow within the quadrupole by controlling gas inlets and outlets of the quadrupole;

in order to trap the ions in the quadrupole during the filling and cooling, applies a direct current (DC) voltage and a radio frequency (RF) voltage to the quadrupole rods, one or more DC voltages to the plurality of auxiliary electrodes, and a DC voltage and an RF voltage to the exit lens, in order to oscillate the ions after the filling and cooling, applies an excitation between at least two rods of the quadrupole rods, and in order to axially eject the oscillating ions through the exit lens and to the destructive detector for detection after the excitation is applied, changes one or more voltages of the one or more DC voltages of the plurality of auxiliary electrodes and changes the DC voltage of the exit lens.

2. The system of claim 1, wherein the processor changes the one or more voltages of the one or more DC voltages of the auxiliary electrodes and changes the DC voltage of the exit lens so that the oscillating ions are ejected fast enough to prevent the loss of coherence, but slow enough to provide the oscillating ions to the destructive detector over a period time long enough to calculate a spectrum from the oscillating ions.

3. The system of claim 1, wherein the processor controls the gas inlets and outlets of the quadrupole to apply the pressure within the quadrupole at a value between $0.5\times10^{-5}$ and $5\times10^{-5}$ torr.

4. The system of claim 1, wherein the plurality of auxiliary electrodes comprise a collar electrode surrounding the central portion of the quadrupole rods, and a plurality of linear accelerator (Linac) electrodes located near the exit end, wherein in order to trap the ions in the quadrupole during the filling and cooling, the processor applies one or more DC voltages to the plurality of auxiliary electrodes by applying a DC voltage to the collar electrode, a DC voltage to the plurality of Linac electrodes, and wherein in order to axially eject the oscillating ions, the processor changes one or more voltages of the one or more DC voltages of the plurality of auxiliary electrodes by changing the DC voltage of the collar electrode.

5. The system of claim 1, wherein the excitation comprises a dipolar DC excitation pulse voltage.

6. The system of claim 5, wherein the processor applies the dipolar DC excitation pulse voltage to the at least two rods of the quadrupole rods by controlling a frequency generator and a toroidal transformer placed between the at least two rods of the quadrupole rods.

7. The system of claim 6, wherein the processor applies the dipolar DC excitation pulse voltage with a pulse width between 0.5 to 5 μs.

8. The system of claim 4, wherein the processor changes the DC voltage of the collar electrode and changes the DC voltage of the exit lens so that the oscillating ions are ejected through the exit lens and to the destructive detector over a time period of between 15 and 30 ms.

9. The system of claim 4, wherein in order to trap positive ions in the quadrupole during the filling and cooling, the processor applies a first DC Linac voltage to the plurality of Linac electrodes, a first DC collar voltage to the collar electrode that is more negative than the first DC Linac voltage, and a first DC exit lens voltage to the exit lens that is more positive than the first DC Linac voltage.

10. The system of claim 9, wherein in order to axially eject the oscillating positive ions through the exit lens and to the destructive detector for detection after the excitation is applied, the processor changes the DC voltage of the collar electrode from the first DC collar voltage to a second DC collar voltage and changes the DC voltage of the exit lens from the first DC exit lens voltage to a second exit lens voltage, wherein the second DC collar voltage is less negative than the first DC collar voltage, but still more negative than the first Linac voltage, and the second exit lens voltage is the same as the first Linac voltage.

11. The system of claim 4, wherein in order to trap negative ions in the quadrupole during the filling and cooling, the processor applies a first DC Linac voltage to the plurality of Linac electrodes, a first DC collar voltage to the collar electrode that is more positive than the first DC Linac voltage, and a first DC exit lens voltage to the exit lens that is more negative than the first DC Linac voltage.

12. The system of claim 11, wherein in order to axially eject the oscillating negative ions through the exit lens and to the destructive detector for detection after the excitation is applied, the processor changes the DC voltage of the collar electrode from the first DC collar voltage to a second DC collar voltage and changes the DC voltage of the exit lens from the first DC exit lens voltage to a second exit lens voltage, wherein the second DC collar voltage is less positive than the first DC collar voltage, but still more positive than the first Linac voltage, and the second exit lens voltage is the same as the first Linac voltage.

13. The system of claim 4, wherein a vertical height of a vertical portion of each Linac electrode of the plurality of Linac electrodes is tapered along a direction of an axis of the quadrupole so that the Linac electrodes are further from an axis of the quadrupole as the Linac electrodes get closer to the exit lens, so that a component of the electric field produced by the DC voltage applied to the plurality of Linac electrodes axially accelerates the oscillating ions towards the exit end of the quadrupole rods.

14. The system of claim 1, wherein the processor further records in a memory over a period of time intensities produced by the destructive detector as the oscillating ions hit the destructive detector, converts the intensities recorded over the period of time to a frequency spectrum using a Fourier transform, and calculates a mass spectrum of the oscillating ions from the frequency spectrum.

15. A method for exciting and ejecting ions for destructive Fourier transform mass spectrometry (FTMS) mass analysis using a linear ion trap (LIT) quadrupole, comprising:

filling a quadrupole with ions and cooling the ions by applying a pressure and gas flow within the quadrupole by controlling gas inlets and outlets of the quadrupole using a processor, wherein the quadrupole includes quadrupole rods that have an entrance end for receiving ions and an exit end for ejecting ions and a plurality of auxiliary electrodes, wherein an exit lens is located coaxially with the quadrupole rods near the exit end of the quadrupole rods, and wherein a destructive detector is located coaxially with the exit lens and located on the other side of the exit lens;

trapping the ions in the quadrupole during the filling and cooling by applying a direct current (DC) voltage and a radio frequency (RF) voltage to the quadrupole rods, one or more DC voltages to the plurality of auxiliary electrodes, and a DC voltage and an RF voltage to the exit lens using the processor;

oscillating the ions after the filling and cooling by applying an excitation between at least two rods of the quadrupole rods using the processor; and axially ejecting the oscillating ions through the exit lens and to the destructive detector for detection after the excitation is applied by changing one or more voltages of the one or more DC voltages of the plurality of auxiliary electrodes and changing the DC voltage of the exit lens using the processor.

16. A computer program product, comprising a non-transitory and tangible computer-readable storage medium whose contents include a program with instructions being executed on a processor so as to perform a method for exciting and ejecting ions for destructive Fourier transform mass spectrometry (FTMS) mass analysis using a linear ion trap (LIT) quadrupole, comprising:

providing a system, wherein the system comprises one or more distinct software modules, and wherein the distinct software modules comprise a filling and cooling control module, an excitation control module, and an ejection control module;

filling a quadrupole with ions and cooling the ions by applying a pressure and gas flow within the quadrupole by controlling gas inlets and outlets of the quadrupole using the filling and cooling control module, wherein the quadrupole includes quadrupole rods that have an entrance end for receiving ions and an exit end for ejecting ions and a plurality of auxiliary electrodes, wherein an exit lens is located coaxially with the quadrupole rods near the exit end of the quadrupole rods, and wherein a destructive detector is located coaxially with the exit lens and located on the other side of the exit lens;

trapping the ions in the quadrupole during the filling and cooling by applying a direct current (DC) voltage and a radio frequency (RF) voltage to the quadrupole rods, one or more DC voltages to the plurality of auxiliary electrodes, and a DC voltage and an RF voltage to the exit lens using the filling and cooling control module;

oscillating the ions after the filling and cooling by applying an excitation between at least two rods of the quadrupole rods using the excitation control module; and axially ejecting the oscillating ions through the exit lens and to the destructive detector for detection after the excitation is applied by changing one or more voltages of the one or more DC voltages of the plurality of auxiliary electrodes and changing the DC voltage of the exit lens using the ejection control module.

* * * * *